US006273794B1

(12) United States Patent
Tietz et al.

(10) Patent No.: US 6,273,794 B1
(45) **Date of Patent: *Aug. 14, 2001**

(54) APPARATUS AND METHOD FOR GRINDING A SEMICONDUCTOR WAFER SURFACE

(75) Inventors: James V. Tietz, Fremont; John M. White, Hayward, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/642,182

(22) Filed: Aug. 17, 2000

Related U.S. Application Data

(63) Continuation of application No. 09/373,096, filed on Aug. 12, 1999, now Pat. No. 6,132,295.

(51) Int. Cl.[7] ..... B24B 1/00
(52) U.S. Cl. ..... 451/41; 451/287; 451/388
(58) Field of Search ..... 451/57, 65, 41, 451/285, 286, 287, 289, 290, 388, 394, 398

(56) References Cited

U.S. PATENT DOCUMENTS 5,679,060 * 10/1997 Leonard et al. ..... 451/43
5,735,731 * 4/1998 Lee ..... 451/143
5,816,895 * 10/1998 Honda ..... 451/41
6,132,295 * 10/2000 Tietz et al. ..... 451/41

* cited by examiner

*Primary Examiner*—Timothy V. Eley
*Assistant Examiner*—Dung Van Nguyen
(74) *Attorney, Agent, or Firm*—Fish & Richardson

(57) ABSTRACT

A semiconductor wafer fabrication apparatus includes a carrier head for holding a wafer and distributing a downward pressure across a back surface of the wafer. The apparatus also includes a wafer processing station disposed near the carrier head. The station includes a grinding wheel and a flat fluid bearing. The fluid bearing provides an upward pressure against a front surface of the wafer to substantially flatten the front surface of the wafer and conform it to the flatness of the bearing surface. The face of the wafer can move with very little friction across the bearing surface. The grinding wheel can be raised into contact with the front surface of the wafer and rotated to grind the front surface while the fluid bearing provides the upward pressure and the carrier head distributes the downward pressure. The technique can be used to planarize a wafer having one or more previously-formed layers despite variations in thickness of the wafer or warpage of the wafer.

20 Claims, 8 Drawing Sheets

APPARATUS AND METHOD FOR GRINDING A SEMICONDUCTOR WAFER SURFACE

The application is a continuation of U.S. patent application Ser. No. 09/373,096, filed Aug. 12, 1999 U.S. Pat. No. 6,132,295.

BACKGROUND

The present invention relates generally to an apparatus and method for grinding a semiconductor wafer surface and, in particular, to grinding techniques that can be used to planarize a semiconductor surface during the fabrication of an integrated circuit.

In the process of fabricating modern semiconductor integrated circuits (ICs), it is necessary to form various material layers and structures over previously-formed layers and structures. However, the prior formations often leave the top surface topography of an in-process wafer highly irregular, with bumps, areas of unequal elevation, troughs, trenches and/or other surface irregularities. Such irregularities cause problems when forming the next layer. For example, when printing a photolithographic pattern having small geometries over previously-formed layers, a very shallow depth of focus is required. Accordingly, it becomes essential to have a flat and planar surface. Otherwise, some parts of the pattern will be in focus and others will not. Surface variations on the order of less than 1,000 angstroms (Å) over a 25×25 millimeter (mm) exposure area are preferred. Additionally, if the irregularities are not leveled at each major processing step, the surface topography of the wafer can become even more irregular, causing further problems as the layers stack up during further processing. Depending on the die type and the size of the geometries involved, the surface irregularities can lead to poor yield and device performance. Consequently, it is desirable to planarize, or level, the IC structures.

One technique for planarizing the surface of a wafer is chemical mechanical polishing (CMP). In general, CMP planarization involves holding a thin flat semiconductor wafer against a rotating wetted polishing surface, such as a compliant polishing pad, under a controlled downward pressure. During the CMP process, a slurry is provided to remove and flush away unwanted film material. In one exemplary implementation, a CMP process is used to remove an oxide coating to the level of previously-formed IC structures. In such processes, it is important to remove a sufficient amount of material to provide a smooth surface without removing an excessive amount of underlying materials.

Although CMP processes have proved useful in the fabrication of semiconductor ICs, they suffer from several drawbacks. First, CMP processes are relatively slow, with a removal rate on the order of about 1 micron per minute ($\mu$/min), and, therefore, limit the overall throughput of the fabrication process. Second, polishing pads typically used in CMP processes tend to have relatively short lifetimes and must be replaced frequently. Third, the use of slurry and other chemicals during the CMP process increases the overall cost of fabrication and results in the need for additional waste removal.

Grinding processes, in which a grinding wheel is pressed against the wafer surface to grind away semiconductor material, are sometimes used by manufacturers of semiconductor wafers to planarize the wafer surface or provide a smooth wafer edge. Grinding processes can avoid some of the foregoing problems associated with CMP processes.

However, as explained below, such grinding processes have not generally been used during the fabrication of semiconductor ICs.

The topography of the front surface of a wafer may vary by as much as 1–2 microns ($\mu$) as a result of the natural distortions or warpage of the wafer as well as variations in the thickness of the wafer across its surface. In contrast to CMP processes in which the wafer is supported by a compliant pad, grinding processes use a hard grinding surface to remove from the wafer surface all materials in substantially an absolute geometrical reference plane. Therefore, because of the wafer's front surface topography, it is difficult to use a grinding process to planarize a wafer having one or more previously-formed layers without removing an excessive amount of underlying materials on at least some parts of the wafer.

Despite the apparent difficulties in using grinding processes to planarize the wafer during the fabrication of ICs, it would be beneficial to provide a planarization technique based on a grinding process that can provide a substantially flat surface across the entire wafer and that can overcome some of the drawbacks associated with current CMP processes.

SUMMARY

In general, according to one aspect, a semiconductor wafer fabrication apparatus includes a carrier head for holding a wafer and distributing a downward pressure across a back surface of the wafer. The apparatus also includes a wafer processing station disposed below the carrier head. The station includes a grinding wheel and a fluid bearing. The fluid bearing provides an upward pressure against a front surface of the wafer so as to substantially flatten the front surface of the wafer. The grinding wheel can be raised into contact with the front surface of the wafer and rotated to grind the front surface while the fluid bearing provides the upward pressure and the carrier head distributes the downward pressure.

According to another aspect, a semiconductor wafer fabrication apparatus includes a carrier head for holding a wafer and distributing a downward pressure across a back surface of the wafer. The apparatus further includes fluid bearing surface areas separated by a gap. The fluid bearing surface areas have openings through which a fluid can flow to provide an upward pressure against a front surface of the wafer when positioned over the bearing surface. The apparatus also includes a grinding wheel at least partially disposed within the gap. The carrier head can be moved to position the wafer over the bearing surface areas and the gap. The grinding wheel can be brought into contact with the front surface of the wafer to grind the front surface when the wafer is positioned over the bearing surface and the gap.

In another aspect, a method of grinding a semiconductor wafer includes positioning the wafer over fluid bearing surface areas separated by a gap, wherein the fluid bearing surface areas have openings through which a fluid flows to provide an upward pressure against the front surface of the wafer. A substantially uniform pressure is provided against the back surface of the wafer. A grinding wheel at least partially disposed in the gap is moved into contact with the front surface of the wafer. The grinding wheel is then rotated against the front surface of the wafer.

Various implementations include one or more of the following features. The grinding wheel can include an annular-shaped grinding surface and can encircle part of the bearing surface. In other embodiments, the grinding wheel can be disc-shaped. Alternatively, an abrasive drum can be used as the grinding wheel.

The grinding wheel can be rotated to grind the front surface of the wafer. Similarly, the carrier head can be moved about a plane substantially parallel to the front of the wafer so that substantially the entire front surface of the wafer comes into contact with the grinding wheel during grinding.

The carrier head can include a wafer backing assembly having a compliant material to provide a mounting surface for the wafer. The carrier head also can include a chamber that is pressurized to generate a downward pressure on the wafer backing assembly and press the wafer toward the bearing surface. By controlling the downward pressure from the carrier head and the upward pressure from the fluid bearing, the front surface of the wafer can be substantially flattened and maintained at a substantially uniform height when positioned for grinding by the grinding wheel. Additionally, closed-loop feedback can be used to adjust the amount of fluid flowing through the openings in the fluid bearing to control the upward pressure against the front surface of the wafer.

A cavity can be formed around the gap so that a pressure in the cavity is maintained at substantially the same pressure as a pressure at the fluid bearing surface opposite the front surface of the wafer.

Various implementations include one or more of the following advantages. By substantially flattening the front surface of the wafer with respect to the vertical position of the grinding wheel, the present techniques can be used to planarize a wafer having one or more previously-formed layers despite variations in thickness of the wafer or warpage of the wafer.

Using a grinding technique rather than a CMP technique to planarize the wafers during the integrated circuit fabrication process can significantly increase the overall throughput of the IC fabrication system. As pre viously mentioned, CMP processes tend to remove materials from the wafer surface at a relatively slow rate, typically less than one $\mu$/min. In contrast, the grinding processes using the present technique can remove materials at a rate of about ten or more times greater.

The present grinding-based technique does not require the use of slurry or other chemicals that are typically used during CMP processes. Therefore, the present invention can reduce the overall cost of fabrication because slurry and other chemicals are not needed. Similarly, the invention can result in fewer waste by-products requiring costly removal. Furthermore, the polishing pads used in CMP processes have relatively short lifetimes and must be replaced periodically on the other hand, a grinding wheel has a much longer lifetime, thereby reducing the time during which the system cannot be used because of maintenance requirements.

Other features and advantages will be apparent from the detailed description, the drawings and the claims.

DETAILED DESCRIPTION

Figure 1:
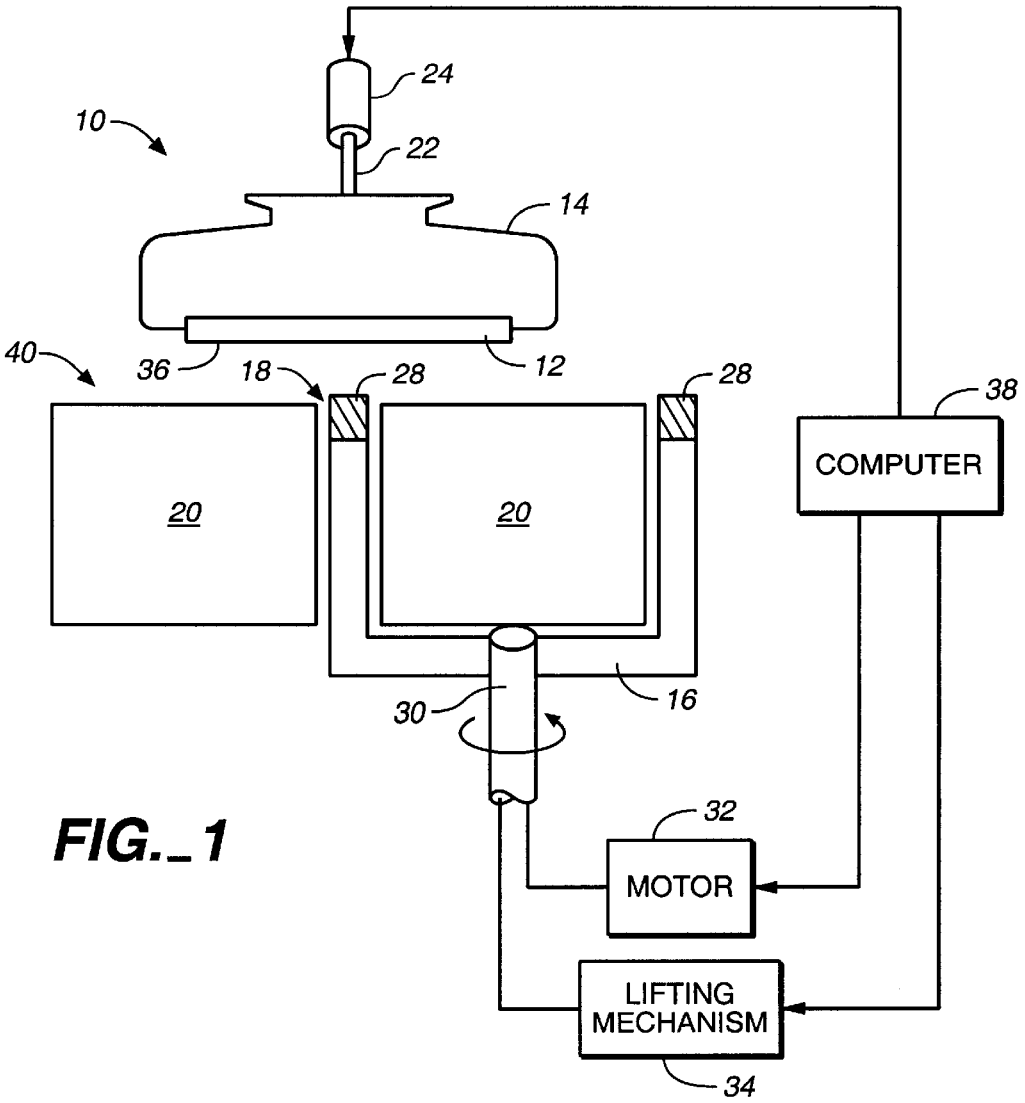
FIG. 1 is a cross-sectional view of an exemplary system for grinding a surface of a semiconductor wafer according to the invention .
Figure 2:
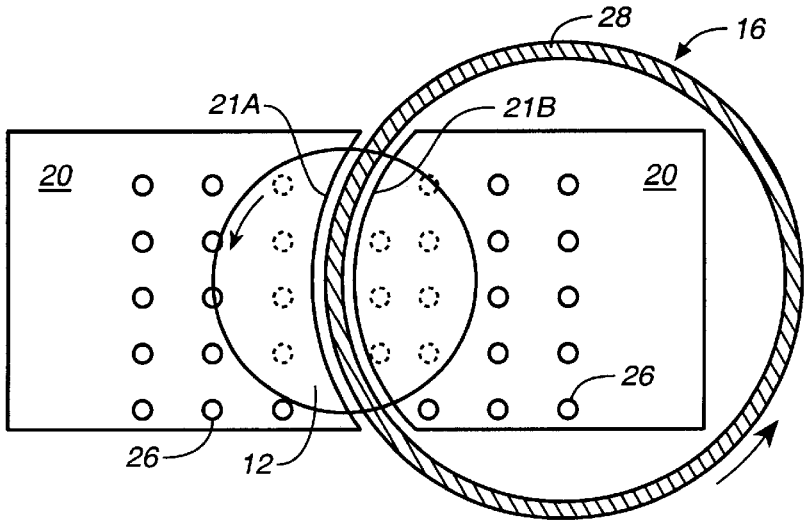
FIG. 2 is a plan view of the grinding station according to the invention.

As shown in FIGS. 1 and 2, a system 10 for planarizing a surface of a semiconductor wafer 12 includes a carrier head 14 and a grinding station 40. The carrier head 14 performs several mechanical functions. Generally, the carrier head 14 holds the wafer 12 and can position the wafer above a fluid bearing surface 20. The carrier head 14 evenly distributes a substantially uniform downward pressure across the entire back surface of the wafer 12. A carrier drive shaft 22 connects a carrier head motor 24 to the carrier head 14 allowing the carrier head to be moved by translation and/or rotation. A grinding wheel 16 is at least partially disposed in a gap 18 formed at the upper surface of the fluid bearing 20.

An exemplary carrier head that can be used with the present invention is the Titan Head™ manufactured by Applied Materials, Inc. A description of a suitable carrier head that can be used with the present invention is disclosed in pending U.S. patent application Ser. No. 08/861,260, filed May 21, 1997 and assigned to the assignee of the present invention. The disclosure of that application is incorporated herein by reference.

Figure 3:
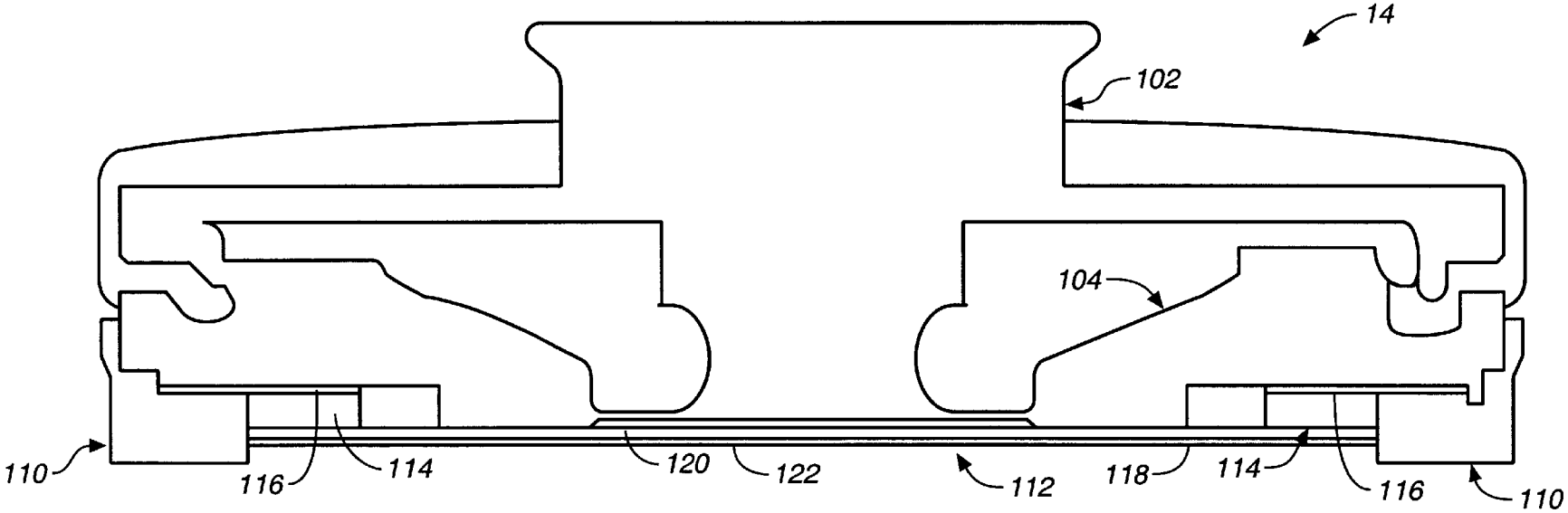
FIG. 3 illustrates an exemplary carrier head for use in the invention.

As shown in FIG. 3, the carrier head 14 can include a housing 102, a retaining ring 110, and a wafer backing assembly 112. A downward force on the wafer backing assembly 112 presses the wafer against the fluid bearing generated by a fluid flowing through the fluid bearing surface 20.

The wafer backing assembly 112 includes a support structure 114, a flexure 116 connected between the support structure 114 and base 104, and a flexible membrane 118 connected to the support structure 114. The flexible membrane 118 extends below the support structure 114 to provide a mounting surface 122 for the wafer.

The fluid bearing surface 20 can be implemented, for example, as a metal, ceramic or other plate with multiple openings 26 such as holes in its upper surface through which a fluid can flow. The holes 26 preferably are spaced apart by about 1 cm or less, and the fluid exiting the holes provides an upward force against the front surface 36 of the wafer 12. Preferably the fluid providing the upward pressure is deionized water, although other liquids or gases can be used. Instead of holes, the openings can take the form of grooves or slots. During the grinding process, the upward pressure of the fluid against the wafer 12 is balanced by the downward pressure from the carrier head 14 to maintain the entire front surface 36 of the wafer 12 at a substantially uniform height. Typically, in order to maintain the backpressure on the system, the carrier head 14 will cover all the openings 26 in the fluid bearing 20. Alternatively, computer-controlled valves can be provided so that, during the grinding process, the fluid flows only through the openings 26 that are covered by the carrier head 14 and/or the wafer 12.

The fluid bearing formed by the water or other fluid exiting from the holes 26 acts like a tight spring having a relatively high stiffness, whereas the membrane 118 acts like a weak spring which is relatively compliant, in other words, which has relatively low stiffness. Therefore, when the carrier head 14 lowers the wafer 12 and brings it to a predetermined height slightly above the surface of the fluid bearing 20, the front surface 36 of the wafer is pressed against the fluid bearing and made substantially flat. In other words, any unevenness in the flatness of the wafer 12 appears on the back (top) side of the wafer. The relatively stiff fluid bearing presented to the front surface 36 of the wafer 12, together with the flat and stiff fluid bearing surfaces 20, allows the entire front surface of the wafer to be maintained at a substantially uniform height with respect to the upper surface 28 of the grinding wheel 16 during the grinding process. The effects of wafer warpage and variations in thickness across the wafer can, therefore, be reduced.

Figure 4:
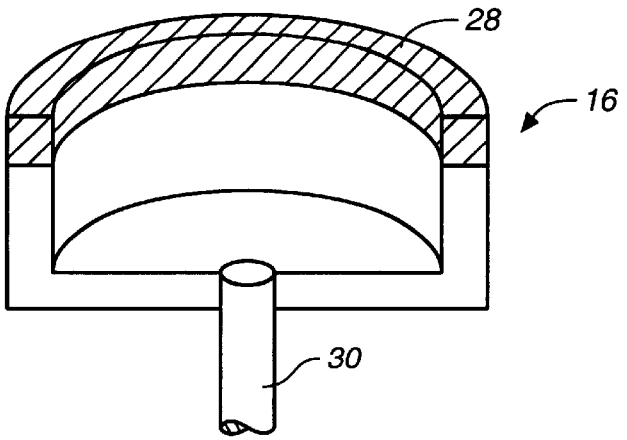
FIG. 4 illustrates a partial view of a cup-shaped grinding wheel for use in the invention.

In one implementation, the grinding wheel 16 is cup-shaped with an annular-shaped abrasive surface 28, as shown in FIG. 4. The material(s) which form the abrasive surface 28 of the grinding wheel 16 will generally depend on the particular application. However, exemplary materials include cerium oxide, aluminum oxide, silicon dioxide and silicon carbide in a polymer matrix. Other materials can also be used.

As shown in FIG. 2, the abrasive surface 28 of the grinding wheel 16 encircles part of the fluid bearing and is secured to the top of a grinding wheel axis 30. The grinding wheel axis 30 is connected to a motor 32 for rotating the grinding wheel 16 and is connected to a lifting mechanism 34 for raising and lowering the grinding wheel. The lifting mechanism 34 can be pneumatically actuated to allow the grinding wheel 16 to be raised and pressed into contact with the front surface 36 of the wafer 12. Rotating the grinding wheel 16 while it is in contact with the wafer 12 causes the front surface 36 of the wafer to be ground. The lifting mechanism 34 allows the grinding wheel to be advanced as the face of the grinding wheel is worn away.

In one implementation, for a 200 mm diameter wafer 12, the gap 18 in the fluid bearing surface is on the order of about one centimeter (cm) with the grinding surface 28 having a radial thickness on the order of about 0.5 cm or less. As shown in FIG. 2, one side 21A of the fluid bearing 20 that is adjacent the grinding wheel 16 can be convex-shaped to conform to the circular shape of the grinding wheel. Similarly, another side 21B of the fluid bearing that is adjacent the grinding wheel 16 can be concave-shaped. In general, the particular dimensions can vary depending on the application. As also can be seen in FIG. 2, the contact area between the wafer 12 and the grinding wheel forms an arc across the wafer. As the grinding wheel 16 rotates at a relatively high speed, for example at about 10,000 to 30,000 revolutions per minute, the wafer 12 is rotated by the carrier head 14 at a relatively low speed, for example at about sixty revolutions per minute. More generally, however, both the wafer 12 and the grinding wheel 16 can be rotated at different speeds from the foregoing speeds. In this manner, the entire front surface 36 of the wafer 12 can be ground with the front surface of the wafer at a substantially uniform height during the grinding process.

In the illustrated implementation, the fluid bearing surfaces 20 can either be suspended from above or can be supported by a base from below.

The operation and control of the system 10 are automated through the use of a computer 38. The computer 38 controls the vertical positioning and rotational speed of the carrier head 14 holding the wafer 12. The computer 38 also controls pressurization of the chamber 120 to establish the downward pressure on the backside of the wafer 12. Additionally, the computer 38 controls the vertical positioning and rotational speed of the grinding wheel 16. The computer 38 also can control the amount of fluid flowing through the holes 26 in the fluid bearing 20 to establish a particular upward pressure against the front surface 36 of the wafer 12. To account for non-uniformities in the height of the upper surfaces of the fluid bearing 20, the computer 38 can use closed-loop feedback to control the local upward pressure generated by the fluid flowing through the holes 26. In particular, using fluid control valves (not shown), the computer 38 can independently control the amount of water flowing through each hole or group of holes 26 in the fluid bearing surfaces 20. To facilitate such closed-loop feedback, sensors (not shown) can be provided between the holes 26 to sense the proximity of the front surface 36 of the wafer at different points. The computer 38 can then adjust the flow of fluid through the holes 26 to obtain a more uniform distance between the upper surface of the fluid bearing 20 and front of the wafer.

Figure 5:
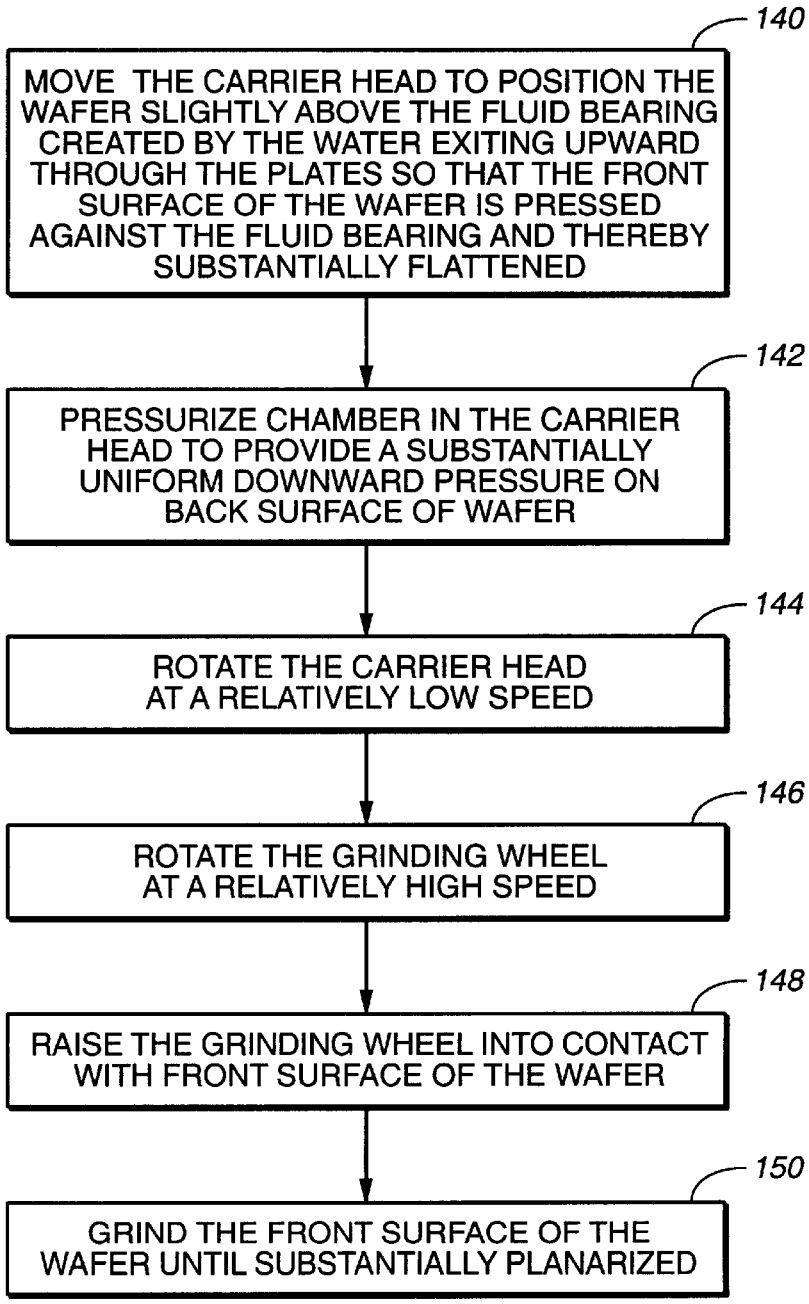
FIG. 5 is a flow chart of a method for planarizing the surface of a wafer according to the invention.

To planarize the front surface 36 of a wafer 12, the operation of the system 10 is as follows (see FIG. 5). Initially, the computer 38 causes the carrier head 14 to position the wafer 12 slightly above the fluid bearing created by the water exiting upward through the holes 26 (step 140). For example, in one implementation, the wafer 12 is positioned about 1 $\mu$m above the surface of the bearing 20 within a tolerance of about fifty angstroms (Å). Next, the chamber 120 is pressurized to provide a substantially uniform downward pressure against the back surface of the wafer (step 142). By pressing the wafer 12 downward against the fluid bearing, the front surface 36 of the wafer is substantially flattened and maintained at a substantially uniform height above the bearing surfaces and grinding wheel. Although there may be a slight downward distortion at the portion of the wafer 12 that is directly above the gap 18, the front surface 36 of the wafer is substantially flat along the length of the gap 18.

The carrier head 14 which holds the wafer 12 is rotated about its axis (step 144), and the computer 38 controls the motor 32 to rotate the grinding wheel 16 (step 146). The rotational speed of the grinding wheel 16 typically will be many times greater than the rotational speed of the wafer 12. The computer then controls the lifting mechanism 34 to raise the grinding wheel 16 into contact with the front surface 36 of the wafer 12 (step 148). As the wafer 12 and grinding wheel 16 rotate while in contact with one another, the front surface of the wafer is planarized (step 150).

By substantially flattening the front surface 36 of the wafer 12 with respect to the vertical position of the grinding wheel 16, the foregoing technique can be used to planarize a wafer 12 having one or more previously-formed layers despite variations in thickness of the wafer or warpage of the wafer. Once the wafer 12 has been sufficiently planarized, rotation of the grinding wheel 16 and carrier head 14 is stopped, and the grinding wheel is lowered out of contact with the front surface 36 of the wafer.

Figure 6:
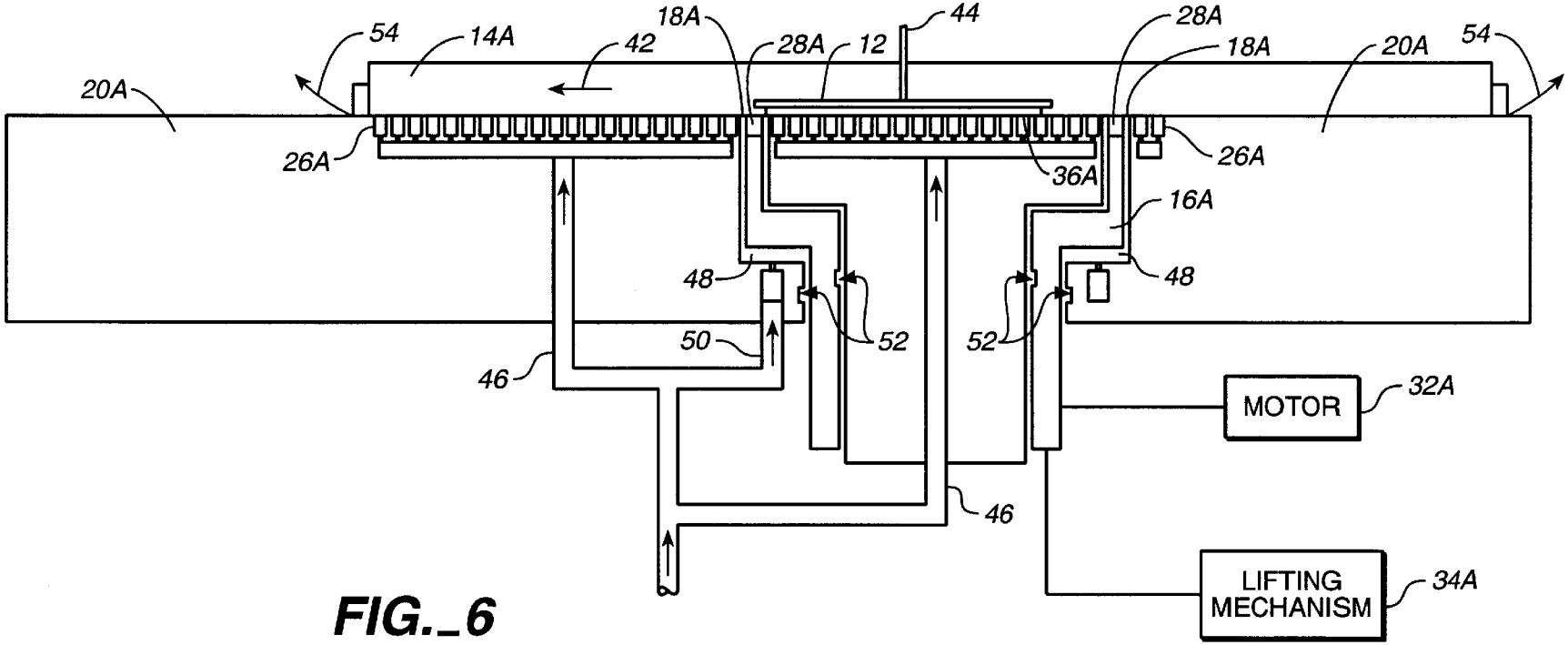
FIG. 6 illustrates a cross-sectional view of another embodiment of an exemplary system for grinding a surface of a semiconductor wafer according to the invention.
Figure 7:
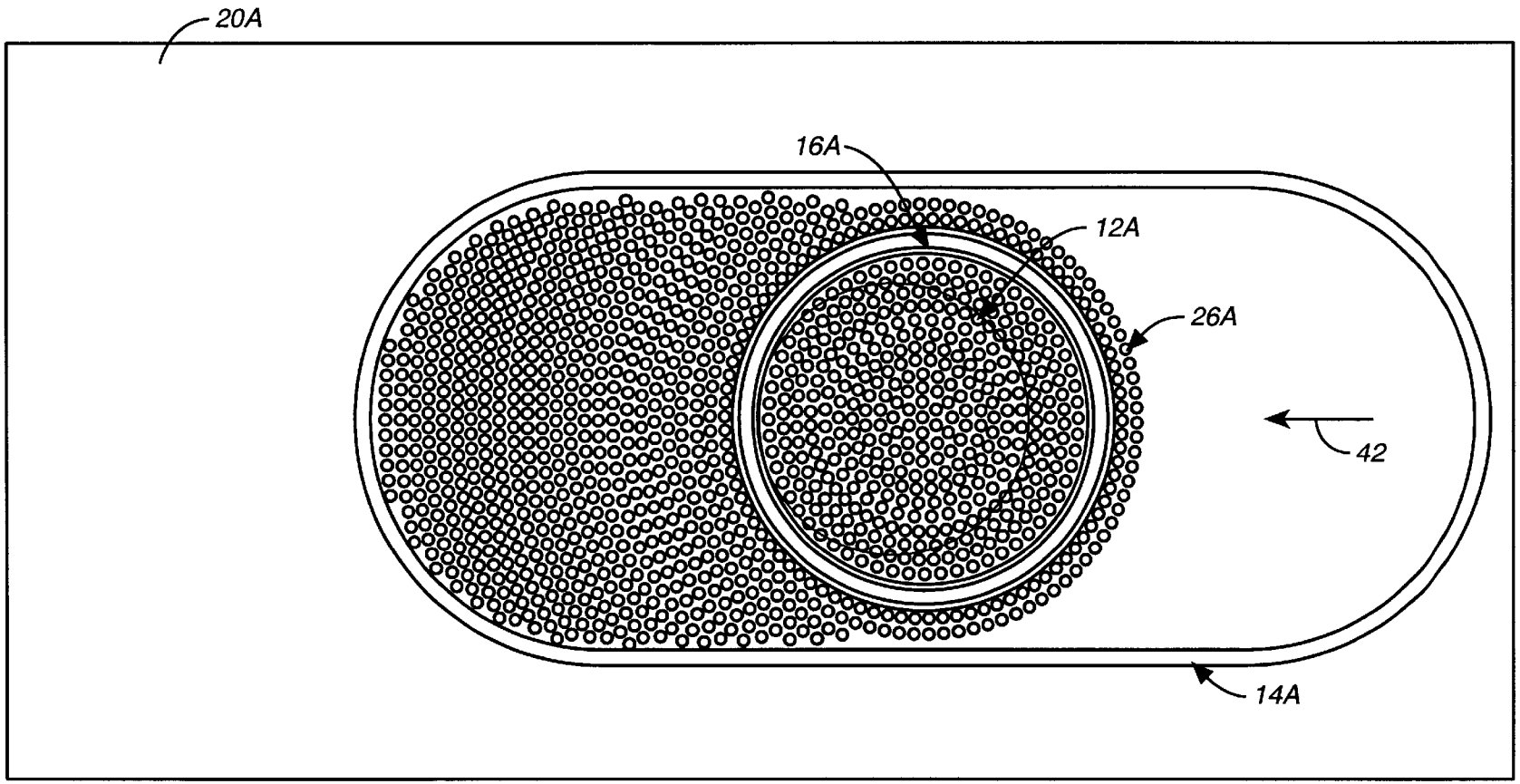
FIG. 7 is a plan view of the system of FIG. 6.

Another implemention of a system with a cup-shaped grinding wheel 16A for grinding the surface of a wafer 12 is illustrated in FIGS. 6 and 7. The carrier head 14A is sufficiently large so that as its position is advanced, as indicated by arrow 42, the carrier head continues to cover the openings 26A on the upper surface areas of the fluid bearing 20A. An inlet 44 is provided in the carrier head 14A through which a fluid can flow to control the downward pressure exerted on the backside of the wafer 12. The openings 26A through which the fluid flows can be arranged, for example, in a radial pattern as shown in FIG. 7 to conform to the contours of the grinding wheel 16A. Fluid can be provided to the openings 26A via fluid lines 46.

As in the previous embodiment, part of the grinding wheel 16A, which includes an abrasive surface 28A, is disposed in one or more gaps 18A in the fluid bearing. In addition, during the grinding operation, a cavity 48 is formed around each gap 18A so that the pressure in the cavity can be controlled and maintained at substantially the same pressure as the pressure in the fluid bearing at the front surface 36A of the wafer 12. Fluid can be provided to the cavity 48 via a fluid line 50, and dynamic seals 52 can be used to control and maintain the cavity pressure. As in the previous embodiment, a motor 32A is provided to rotate the grinding wheel 16A about its axis to polish the wafer. A lifting mechanism 34A allows the grinding wheel 16A to be raised and pressed into contact with the front surface 36A of the wafer 12 and permits the grinding wheel to be advanced as the face of the grinding wheel is worn away. The fluid that flows through the openings 26A eventually flows from between the carrier head 14A and the fluid bearing in the directions indicated by the arrows 54.

Figure 8:
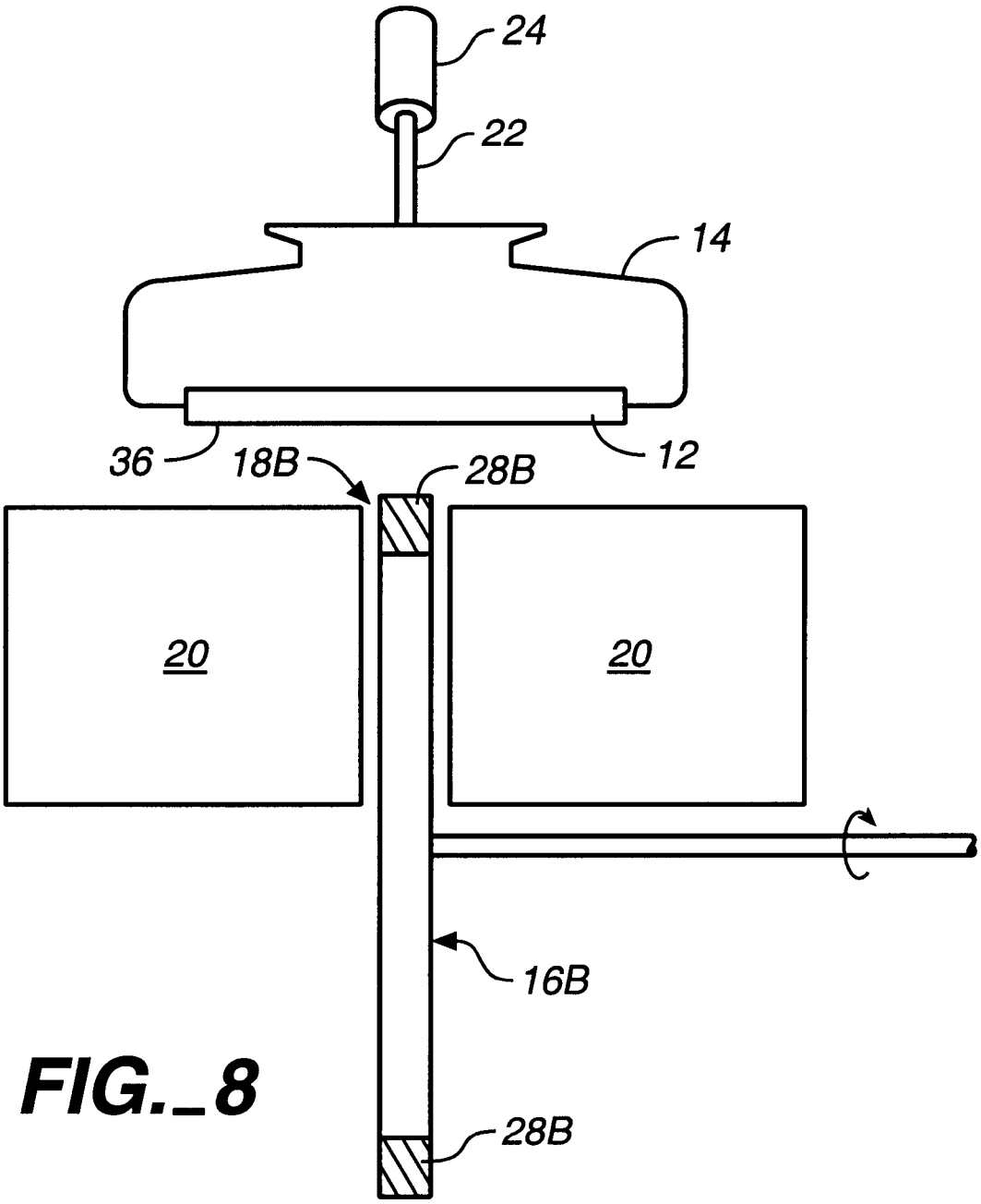
FIG. 8 is a cross-sectional view of an embodiment of a grinding system using disc-shaped grinding wheel according to the invention.

Although the implementations described above use a cup-shaped grinding wheel having an annular-shaped grinding surface, other types of grinding wheels can be used instead. For example, a disc-shaped grinding wheel 16B with an abrasive surface 28B can be used as illustrated in FIG. 8. Other features of the system illustrates in FIG. 8 are similar to the system of FIG. 1. The wafer 12 can be moved back and forth in a plane substantially parallel to the upper surface of the fluid bearing 20 so that the entire front surface of the wafer can be planarized.

Figure 9:
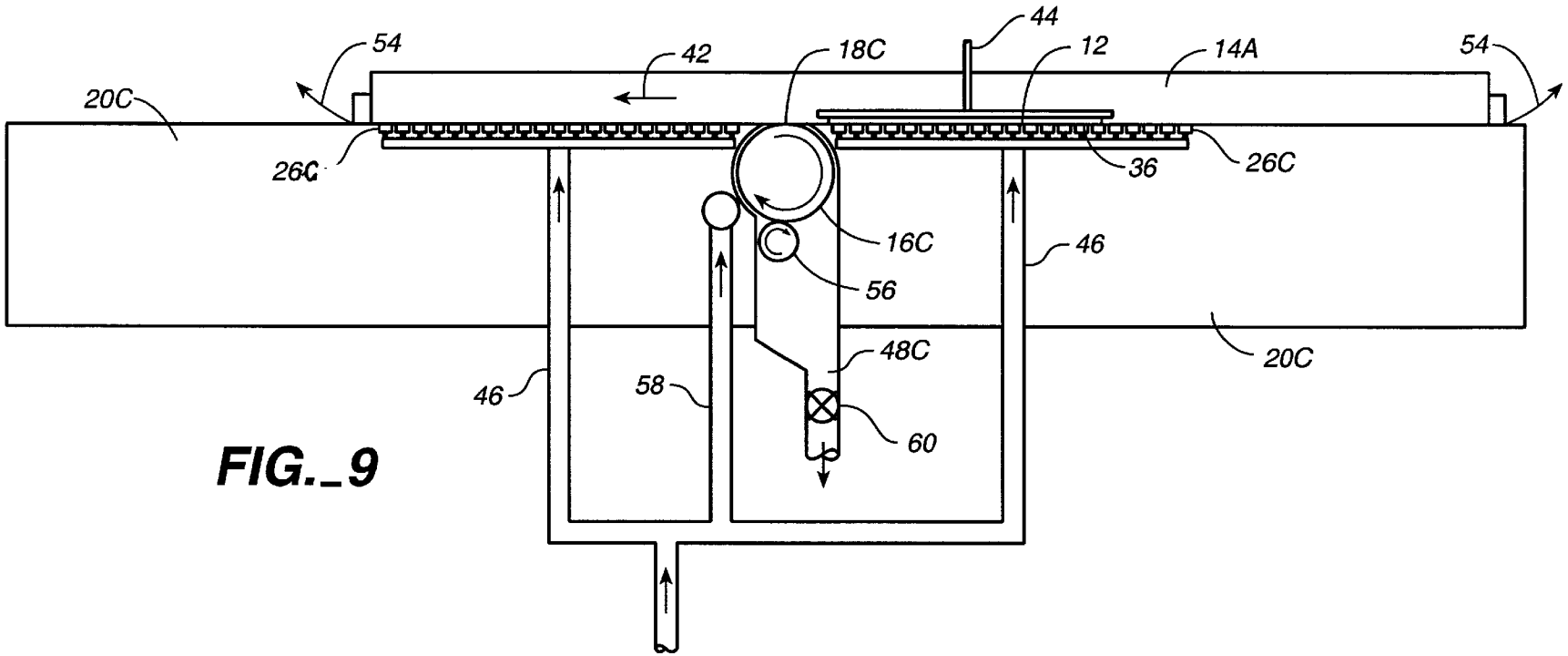
FIG. 9 is a cross-sectional view of an embodiment of a grinding system using an abrasive drum as the grinding wheel according to the invention.
Figure 10:
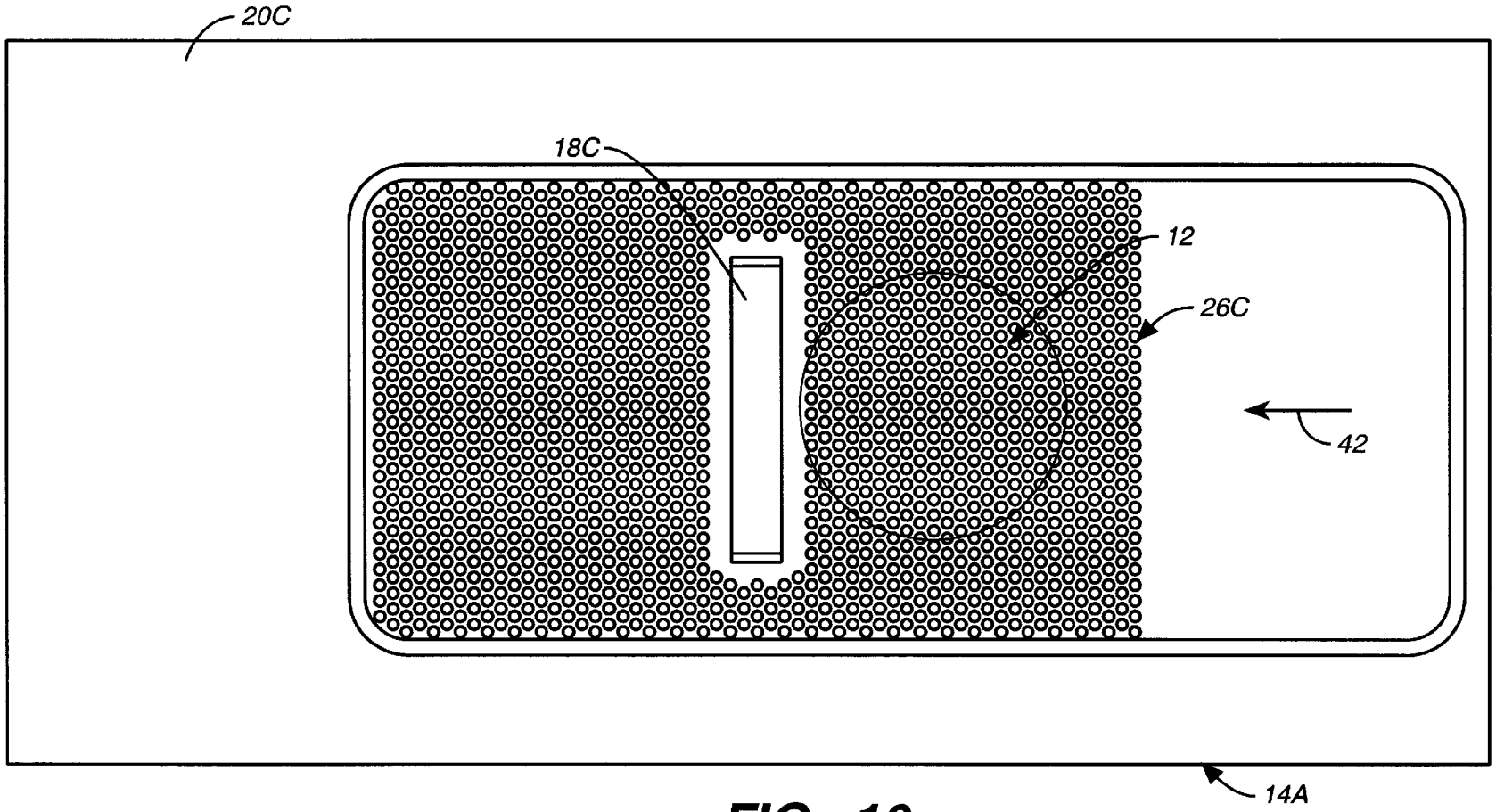
FIG. 10 is a plan view of the system of FIG. 9.

In yet another implementation, an abrasive drum 16C is used as the grinding wheel. A conditioning drum 56 can be provided adjacent the abrasive drum 16C. The openings 26C in the surface of the fluid bearing 20C through which the fluid flows can be arranged, for example, in a rectangular or hexagonal pattern as shown in FIG. 9. Part of the grinding wheel 16C is disposed in a gap 18C in the fluid bearing. A cavity 48C is formed around the gap 18C so that the pressure in the cavity can be controlled and maintained at substantially the same pressure as the pressure in the fluid bearing at the front surface 36 of the wafer 12. Fluid can be provided to the cavity 48 via a fluid line 58, and a control valve 60 can be used to control and maintain the cavity pressure. Other features of the system in FIG. 9 can be similar to the system of FIG. 7.

The system 10 can be part of a larger system including multiple polishing, grinding or other integrated circuit fabrication process stations. For example, the grinding wheel 16 and fluid bearing 20 can form the grinding station 40 for planarizing the front surface of wafers. Similarly, the carrier head 14 can be one of several carrier heads mounted on a rotatable multi-head carousel. The multi-head carousel would then be rotated to move the carrier heads with their respective wafers from one station to another during the fabrication process. In some implementations, the carrier heads may be capable of holding more than one wafer at a time.

Other implementations are within the scope of the claims.

What is claimed is:

1. A semiconductor wafer fabrication apparatus comprising:

a carrier head for holding a wafer and distributing a downward pressure across a back surface of the wafer;

a fluid bearing having surface areas separated by a gap, wherein the surface areas have openings through which a fluid can flow to provide an upward pressure against a front surface of the wafer when positioned over the fluid bearing surface areas; and a polishing surface at least partially disposed within the gap, wherein the carrier head can be moved to position the wafer over the fluid bearing surface areas and over the gap, and wherein the polishing surface can be brought into contact with the front surface of the wafer to polish the front surface while the wafer is positioned over the bearing surface areas and the gap.

2. The apparatus of claim 1 wherein the front surface of the wafer is maintained at a substantially uniform height above the fluid bearing surface areas when positioned for polishing by the polishing surface.

3. The apparatus of claim 2 wherein the polishing surface includes an annular-shaped surface.

4. The apparatus of claim 3 wherein, when the polishing surface is brought into contact with the wafer, an arc-shaped contact area between the polishing surface and the wafer is formed.

5. The apparatus of claim 3 wherein the annular-shaped surface rotates to polish the front surface of the wafer.

6. The apparatus of claim 5 wherein the carrier head can be rotated about its axis so that substantially the entire front surface of the wafer comes into contact with the polishing surface.

7. The apparatus of claim 6 wherein the annular-shaped surface rotates at a much greater speed than the carrier head.

8. The apparatus of claim 6 wherein the carrier head can be translated so that substantially the entire front surface of the wafer comes into contact with the polishing surface.

9. The apparatus of claim 1 wherein the polishing surface partially encircles part of the fluid bearing.

10. The apparatus of claim 1 wherein the openings in the fluid bearing surface areas are arranged in a radial pattern.

11. The apparatus of claim 1 wherein the openings in the fluid bearing surface areas are arranged in a rectangular pattern.

12. The apparatus of claim 1 wherein the polishing surface is a top surface of a grinding wheel.

13. A semiconductor wafer fabrication apparatus comprising:

a carrier head for holding a wafer and distributing a downward pressure across a back surface of the wafer;

a wafer processing station, wherein the station includes:

a polishing surface; and a fluid bearing for providing an upward pressure against a front surface of the wafer so as to substantially flatten the front surface of the wafer, wherein the polishing surface can be raised into contact with the front surface of the wafer and moved relative to the wafer to polish the front surface while the carrier head distributes the downward pressure across the back surface of the wafer.

14. A method of polishing a semiconductor wafer, the method comprising:

positioning the wafer over fluid bearing surface areas separated by a gap, wherein the fluid bearing surface areas have openings through which a fluid flows to provide an upward pressure against a front surface of the wafer;

providing a substantially uniform pressure against a back surface of the wafer;

positioning a polishing surface at least partially in the gap and in contact with the front surface of the wafer; and moving the polishing surface against the front surface of the wafer.

15. The method of claim 14 including maintaining the front surface of the wafer at a substantially uniform height above the fluid bearing surface areas when the wafer is polished by the polishing surface.

16. The method of claim 14 including planarizing the front surface of the wafer by polishing the front surface of the wafer with the polishing surface.

17. The method of claim 16 further including holding the wafer with a carrier head.

18. The method of claim 14 wherein the polishing surface includes a grinding wheel, and moving the polishing surface includes rotating the grinding wheel.

19. The method of claim 18 including translating the wafer during polishing so that substantially the entire front surface of the wafer comes into contact with the polishing surface.

20. The method of claim 14 including rotating the grinding wheel at a greater speed than the carrier head.

* * * * *